US005724668A

United States Patent [19]

Wood et al.

[11] Patent Number: 5,724,668

[45] Date of Patent: Mar. 3, 1998

[54] METHOD FOR DECONTAMINATION OF NUCLEAR PLANT COMPONENTS

[75] Inventors: Christopher John Wood, Mountain View, Calif.; David Bradbury, Tresham; George Richard Elder, Northwood Green, both of United Kingdom

[73] Assignee: Electronic Power Research Institute, Palo Alto, Calif.

[21] Appl. No.: 554,454

[22] Filed: Nov. 7, 1995

[51] Int. Cl.[6] ..... G21F 9/00

[52] U.S. Cl. ..... 588/1; 134/3; 134/10; 134/41; 976/DIG. 376; 376/309

[58] Field of Search ..... 588/1; 134/3, 10, 134/22.11, 41; 976/DIG. 376; 376/309; 156/664

[56] References Cited

U.S. PATENT DOCUMENTS

| | | | |
|---|---|---|---|
| Re. 34,613 | 5/1994 | Hanulik | 252/628 |
| 4,162,229 | 7/1979 | Loewenschuss | 252/301.1 |
| 4,175,011 | 11/1979 | Spiliotis | 204/15 |
| 4,705,573 | 11/1987 | Wood et al. | 134/3 |
| 4,828,759 | 5/1989 | Hanulik | 252/628 |
| 4,915,781 | 4/1990 | Bohnen et al. | 156/664 |
| 5,340,505 | 8/1994 | Hanulik et al. | 588/18 |
| 5,523,513 | 6/1996 | Milner | 588/1 |

FOREIGN PATENT DOCUMENTS

WO 85/04279 9/1985 WIPO .

OTHER PUBLICATIONS

P.J. Petit, J.E. LeSurf, W.B. Steward and S.B. Vaughan, *Corrosion* '78, (Paper #39), Houston, Texas 1978.

Suwa, et al., *J. Nuclear Science and Technology* 25 (7) pp. 574–585, Jul.1988.

*Primary Examiner*—Ngoclan Mai

*Attorney, Agent, or Firm*—Dergosits & Noah LLP

[57] ABSTRACT

A process for removing undesirable material such as a radioactive contaminant from an underlying material. A solution containing fluoroboric acid and a material which affects oxidation potential (Eh) is contacted with the undesirable material to cause its removal. The material is removed from the fluoroboric acid solution by contacting the solution with a cation exchange resin and fluoroboric acid is regenerated in situ for continuous removal of undesirable material.

11 Claims, 3 Drawing Sheets

PROCESS DIAGRAM

PROCESS DIAGRAM

METHOD FOR DECONTAMINATION OF NUCLEAR PLANT COMPONENTS

BACKGROUND OF THE INVENTION

Decontamination of sub-systems of LWR plants has now become relatively common in the United States and is important as a useful contributor to the reduction of radiation exposure of workers at these plants. Sub-system decontamination involves exposing a part of the reactor circuit to chemical decontamination solutions which dissolve radioactive deposits which have accumulated on process equipment which includes piping. The spent decontamination solutions may then be treated by ion exchange to retain the chemical and radioactive burden of the decontamination solution on the resin, while clean water is returned to the system. An example of such a process is the LOMI process, described in U.S. Pat. No. 4,705,573.

One of the purposes of decontamination is to remove the radioactive deposits which can represent a danger to plant workers. Decontamination of plant components which are intended to be returned to service should avoid any damage to materials exposed to the process. Such damage could occur due to corrosion resulting from the process or from normal operating conditions of the nuclear plant subsequent to decontamination. Certain processes which attempt to avoid damage do not attack base metal and operate by dissolving the overlying layer of corrosion product metal oxides.

Although effective in lowering or reducing the amount of radiation to which workers are exposed, such processes do not remove all radioactivity from treated surfaces and are therefore not capable of allowing the plant items to be treated as non-radioactive waste. In order to sufficiently decontaminate radioactive items to be able to classify them as non-radioactive, it is necessary to remove a thin layer of the underlying base metal, so as to release radioactivity trapped in fissures in the metal (occurring, for example, as a result of mild intergranular attack of the metal surface.) For decommissioning a reactor, restrictions concerning plant damage are not as stringent since the plant items are not required for further operational duty. The only requirement with regard to damage is that the plant items maintain their integrity against leakage during the operation of the process while remaining structurally sound. Although the removal of a thin layer of base metal is consistent with these requirements, removal of too much metal may cause a problem concerning the amount of radioactive waste generated.

Several processes have been described for removal of base metal. For example, U.S. Pat. No. 4,828,759 is directed to a process for using fluoroboric acid as a decontaminating reagent. The reagent is capable of dissolving a wide variety of metals and metal oxides. The patent details several methods for using the acid to minimize radioactive waste, for example, recovering the acid by distillation. The process described may be convenient for treating components which are immersed or sprayed in a bath for decontamination. The concentration of acid stated (0.05 to 50 moles per liter) is sufficiently great to avoid the complications of ineffectiveness referred to below.

In some instances, using a dilute chemical system may be advantageous when decontaminating large components of nuclear plants, such as steam generators. The purchase and handling of chemicals is difficult and expensive if concentrated chemical solutions are used, and it is difficult to manage the wastes in a minimum volume. Although a process described in U.S. Pat. No. 4,828,759 overcomes many of these difficulties, the type of equipment proposed is not commonly used in a temporary manner in nuclear plant decontamination, and the process does not easily allow the benefits of exposing the items to be decontaminated to a progressively cleaner decontamination solution. Use of progressively cleaner decontamination solutions is useful for obtaining high decontamination effectiveness in a large convoluted system of plant items contaminated on inaccessible internal surfaces.

Another decontamination solution capable of dissolving base metal involves cerium salts in an acid solution (e.g. German Patent No. DE-PS 2, 714,245). The oxidizing action of cerium (IV) in conjunction with a mineral acid such as nitric acid causes the metals to be dissolved. The cerium (III) resulting from oxidation of the metal can be reoxidized to cerium (IV) by the action of an oxidizing chemical such as ozone. The problem with systems based on cerium as oxidant is that cerium is cationic and is removed and depleted along with metals and radioactivity by ion exchange. It is therefore difficult to provide a system that allows continuous removal of cationic radioactive metals without consequent removal of cerium. The desired objective of treating the system with a progressively cleaner decontamination solution cannot therefore be accomplished conveniently.

SUMMARY OF THE INVENTION

The present invention provides a process for decontaminating a contaminated material which includes providing a solution containing from about 1 to about 50 milli-moles of fluoroboric acid per liter, contacting the solution with a material which causes the oxidation potential (Eh) of the fluoroboric acid solution to range from about 500 to about 1200 mV versus a Standard Calomel Electrode, and contacting the fluoroboric acid solution with the contaminated material and removing a contaminant by contacting the fluoroboric acid solution with a cation exchange resin.

The present invention also provides a process for removing metal from a substrate which includes providing a solution containing from about 1 to about 50 milli-moles of fluoroboric acid per liter, contacting the solution with a material which causes the oxidation potential (Eh) of the fluoroboric acid solution to range from about 500 to about 1200 mV versus a Standard Calomel Electrode, and contacting the fluoroboric acid solution with the substrate and removing metal from the substrate. The metal is removed or recovered from the fluoroboric acid solution by contacting it with a cation exchange resin.

In one aspect, it is an object of the invention to provide decontamination by progressively removing deposits and/or a layer of base metal from a surface in an even and controlled manner, thereby releasing radioactive contamination. In another aspect, it is an object of the invention to allow the surface to be treated with a progressively cleaner decontamination solution as the process proceeds. In yet another aspect, it is an object of the invention to create a minimum volume of radioactive waste from the process.

DETAILED DESCRIPTION OF THE INVENTION

Figure 1:
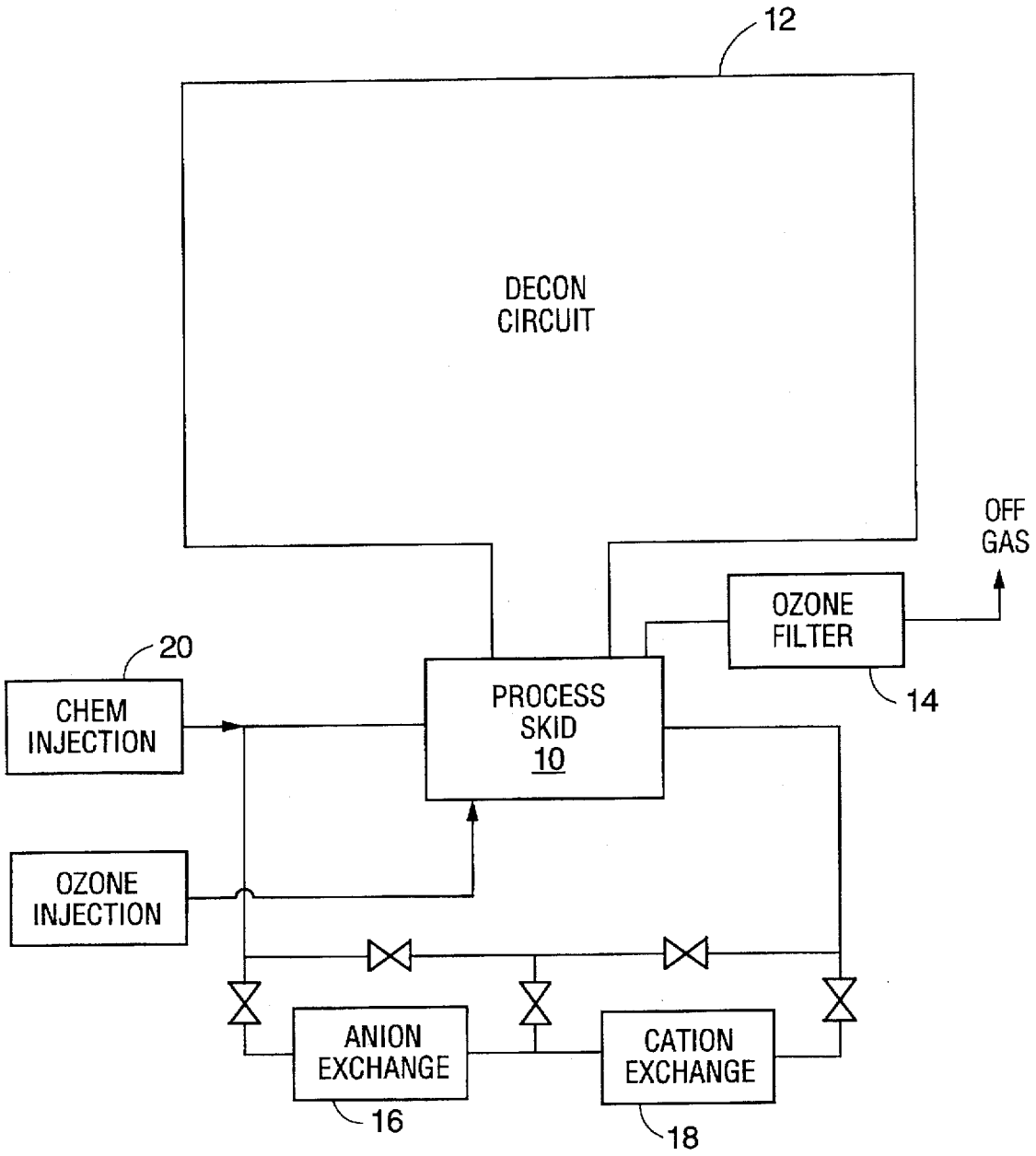
FIG. 1 shows a process block diagram with the major components of the decontamination system of the present invention.
Figure 2A:
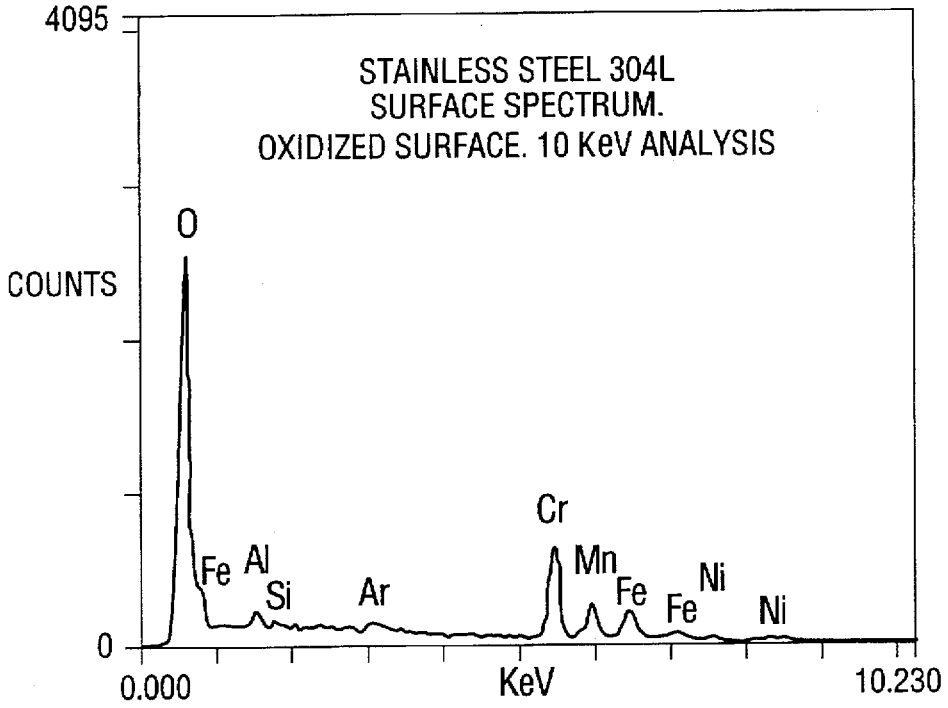
FIGS. 2*a–d* show a series of EDAX analyses of test coupon surfaces.
Figure 2B:
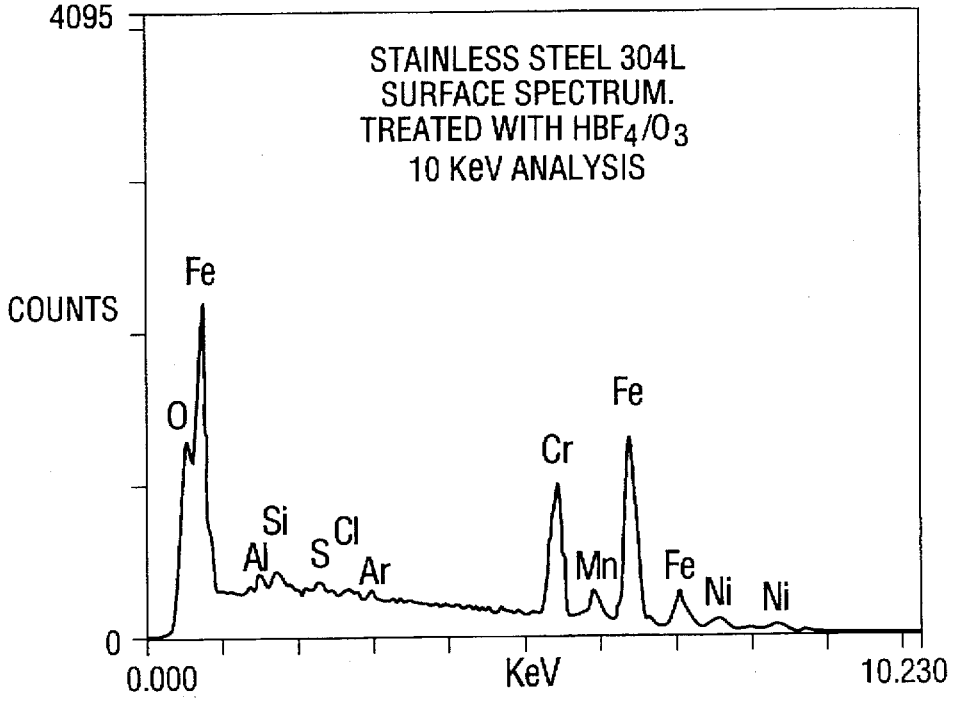
Figure 2C:
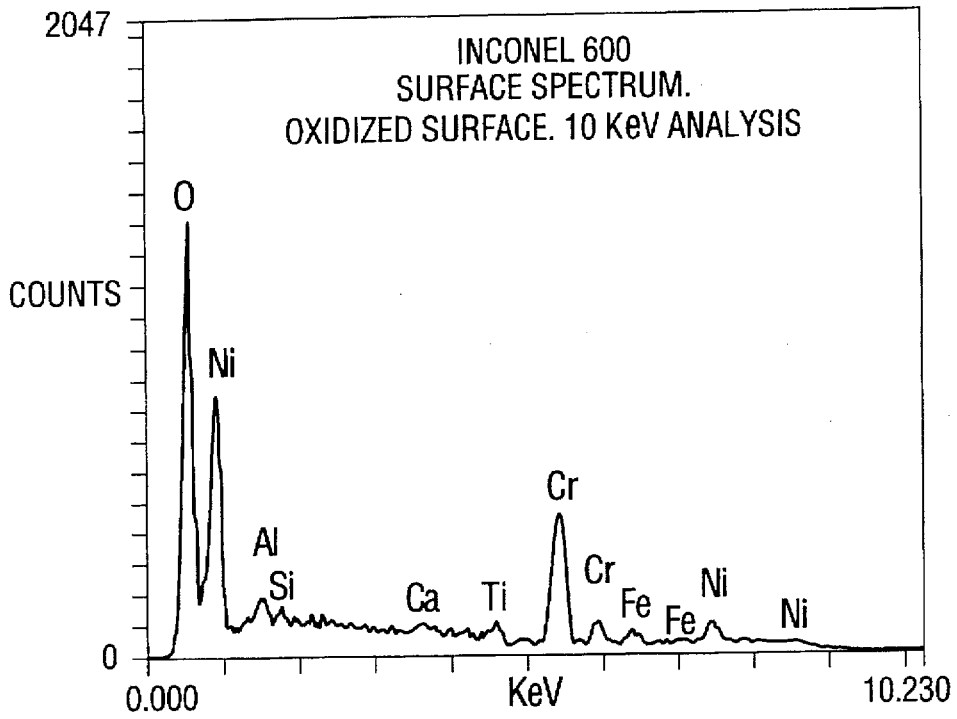
Figure 2D:
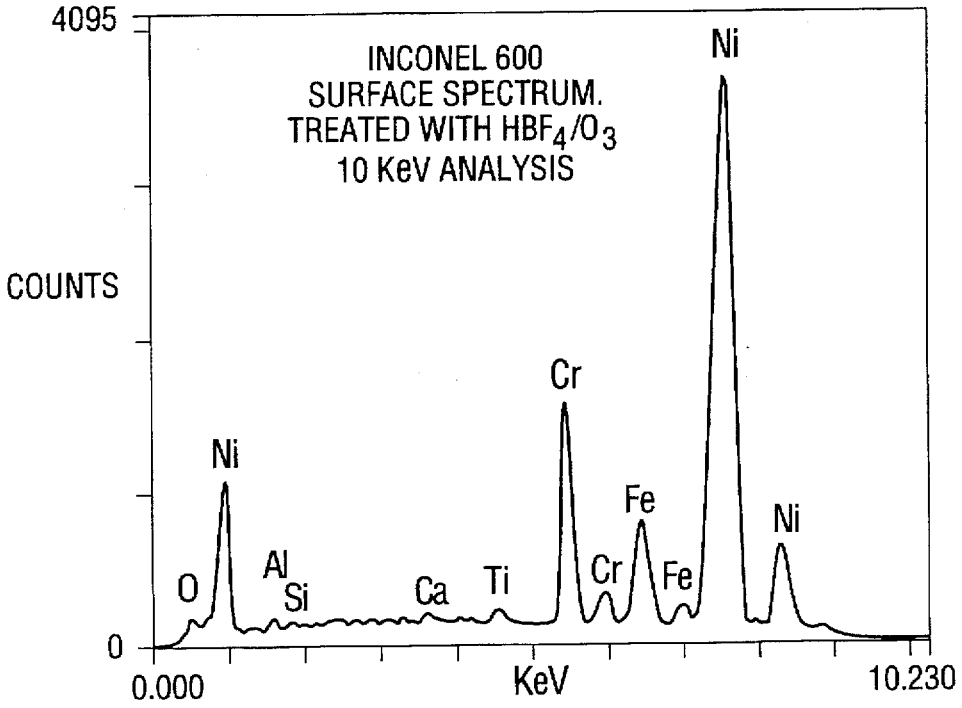

The present invention was developed for the purpose of decontaminating items of nuclear plant which are no longer required for duty. Such items may arise because the whole facility has been taken out of commission, or because a single item (such as a steam generator of a PWR plant) is being replaced. In accordance with the present invention, a decontamination system is provided which uses a dilute reagent that affords easy and economical handling. The decontamination system evenly dissolves base metals and corrosive deposits and is especially well-suited for decontamination of reactor plant components which have been taken out of commission. Furthermore, the system also utilizes certain reagents which can be removed in the gas phase or be converted into species which can be removed in the gas phase, thus leaving no residue. It should be understood that the present invention is applicable not only to removal of radioactive deposits from a substrate, but to removal of non-radioactive deposits, metals, derivatives of metals, and other materials from an underlying substrate.

The chemical reagents used should be dilute (ideally no more than 10 milli-moles per liter) because the quantity of radioactive ion exchange wastes generated is heavily dependent on the quantity of reagents used. There are additional reasons for preferring a dilute chemical concentration, for example, simplification of handing the chemicals on a large plant scale. It was therefore desired to develop a chemical system which was dilute and could evenly dissolve base metal while at the same time being suitable for a recirculating clean up by ion exchange.

The present invention avoids the use of cationic chemical reagents in the decontamination solution for the following reason. In order to achieve a high degree of decontamination effectiveness in a plant system of complex geometry, it is necessary for the system to be treated with solution of progressively lower radioactive content, preferably at the same time as the base metal is being dissolved. In this way it is possible to avoid the potential for recontamination of freshly exposed clean steel surfaces. In a nuclear plant which has not been operational for a period in excess of one year most of the radioactivity typically present in the reactor circuits is in the form of elements which are cationic. Provided that the chemical reagent does not contain a cation (other than hydrogen ion) it is possible to remove the dissolved radioactive elements on a cation exchange resin without removing the chemical reagent. This principle has been used advantageously in other prior art processes which do not dissolve base metal. (e.g. the CANDECON process, See, P. J. Petit, J. E. LeSurf, W. B. Stewart and S. B. Vaughan, *Corrosion* '78, Houston, Tex., 1978).

Prior to the present invention, it was believed that use of fluoroboric acid as a decontamination reagent was ineffective when the concentration of the acid was reduced to an extent sufficient to make its use practical in a large plant system. The reason for this ineffectiveness is the nature of metal oxides deposited or grown on to metal surfaces at high temperatures during reactor operation. Such oxides are soluble only slowly in the dilute fluoroboric acid. The acid penetrates cracks in the oxide structure leaving islands of adherent oxide while the metal at the base of the cracks is dissolved. This behavior has been confirmed by electron microscopy of pre-oxidized metal samples exposed to dilute fluoroboric acid. We have undertaken tests of the effectiveness of fluoroboric acid at controlled conditions of oxidation potential, Eh. The Eh in these experiments has been monitored and controlled by additions of hydrazine, hydrogen peroxide or ozone. In these experiments we have found that the oxide is dissolved much more evenly particularly on stainless steel, as the Eh of the system is increased. Furthermore the rate of removal of oxide from stainless steel is affected far more by Eh than Inconel. The result is that at high values of Eh the rate of removal from both types of metal becomes approximately equal, which is convenient from the point of view of decontaminating a mixed stainless steel/Inconel system.

Turning now to FIG. 1, the items of a plant are formed into a flowpath typically with a process skid 10. The process skid 10 consists of equipment which can be transported easily between one site and another, and connected to the nuclear plant items by temporary pipework 12. The components of the process skid are typically a pump, in-line heater, ozone generator 14, ion exchange vessels 16 and 18, surge tank, and suitable equipment 20 for chemical injection.

The system is filled with water (preferably deionized) and the water is circulated through the system while being heated to the process temperature. The temperature in which the process operates can be from about ambient temperature to about 100° C., but the most preferable range is about 65° C. to about 100° C. The choice of temperature is based upon the rate of dissolution of metal desired. The metal must dissolve sufficiently slowly for the solution to have an invariant pH in all pans of the flowpath, but must dissolve sufficiently rapidly for the process application time to be convenient. Typically, a convenient time for application would be defined as between about two and about forty eight hours. Fluoroboric acid is then injected in concentrated solution, typically 48% (wt) in water, into the system to achieve a concentration in the desired range. This range is about 1 to about 50 milli-moles per liter, but more preferably about 10 milli-moles per liter. Periodically during operation of the process further fluoroboric acid can be injected to maintain the desired concentration. It is important that the desired pH and Eh be maintained throughout the decontamination process.

Ozone is injected from the ozone generator. The ozone generator may be any commercially available device for this purpose, for example, operating on the principle of electric discharge in air or oxygen. (Corona Discharge Ozone Generator, Peak Scientific, United Kingdom.) Optionally ozone present in off gases can be recycled through the solution. The ozone injection rate is controlled throughout the process to achieve the desired value of oxidation potential (Eh) which should be maintained in the range of about 500 to about 1200 mV versus the Standard Calomel Electrode. Off gases from the system should be vented though an ozone filter, of standard commercially available type, to prevent ozone from entering the atmosphere. From there, off gases should be vented to the plant extract system.

The cation exchange column is valved into the system. The rate of flow of solution through the cation exchange column is controlled to maintain the pH of the circulating solution in the correct range. This range is about pH 2 to about pH 3, but most preferably about pH 2.5. Cation and anion exchange resins used for the process may be any ion exchange resins typically used for water purification in the nuclear industry, preferably strong acid cation exchangers such as IR-120 and strong base anion exchangers such as IRA 400.

During the operation of the process the progress of the decontamination may be monitored by measuring the radioactivity circulating in the process solution (by sampling and analysis), and, if convenient, by direct gamma monitoring equipment adjacent to the items to be decontaminated. The majority of the radioactivity is removed by the cation exchange resin, so that the circulating solution has progressively lower levels of circulating radioactivity. The process is complete when no further radioactivity is being removed from the system. During the final cleanup stage, the process solution is circulated through the flowpath and through cation and anion exchange columns, until the desired purity of process water is achieved (e.g., conductivity of about 10 microSiemens). The fluoroboric acid is removed from the system by the anion exchange columns, leaving the system with clean water.

After completion of the process the water can be removed from the system, and the ion exchange resin can be disposed of as radioactive waste in any conventional manner, e.g., hydraulically transferred into a liner for dewatering or other treatment prior to transportation and disposal.

EXAMPLE 1

Sample coupons of Stainless Steel 304 and Inconel 600 were obtained from Metal Samples Inc., Alabama. Coupons were traceable to mill certificates, and were oxidized by the following procedure to produce an oxide coating which has been shown to simulate exposure of the materials to PWR reactor conditions. The samples were degreased in methanol and pickled for 2 minutes in 30% nitric acid (for stainless steel coupons) or 30% sulfuric acid for Inconel coupons. The coupons were washed in demineralized water, rinsed with methanol, and dried in a dessicator to constant weight. The coupons were heated in air at 800 C. for a period of 15 minutes. Average oxide film thicknesses (0.85 microns stainless steel and 0.58 microns Inconel) were calculated from weight gains assuming that the weight gain was due to incorporation of oxygen and that the oxide density was 1.5 $gcm^{-3}$. Scanning electron micrography and EDAX analysis of the coupon surfaces revealed enrichment in oxygen and chromium compared with the base metal, both in the case of the stainless steel and Inconel coupons (FIG. 2).

A recirculating decontamination rig was constructed with a PTFE sample chamber, generally according to the diagram in FIG. 1, though in this particular case no anion exchange column was employed. The system volume was 10 $dm^3$ and the linear flow rate over the coupons was 0.07 m $s^{-1}$. A cation exchange column of 0.5 $dm^3$ capacity (IR-120) in the hydrogen form was provided. The design allowed control of flow rates, temperature and chemical concentrations. Temperature, pH, Eh and flow rate were all recorded on a data logger system. Grab samples of the solution were taken from the bulk recirculating solution and in the outlet from the cation exchange column at various times, and sent for analysis (iron, chromium, nickel and pH). The specimens were placed in the sample chamber and the system filled with demineralized water. The solution was heated to 65 C. Fluoroboric acid was added (13.5 ml, 48% by weight in water) and the ozone generator switched on. Initially the cation exchange column was isolated, but after four hours the ion exchange column was valved in at a flow rate of 10 $dm^3h^{-1}$. Analysis of the bulk solution and "after cation exchange" samples are given in Table 1. Eh was maintained between +600 and +1,000 mV versus Standard Calomel Electrode. The decontamination was continued for 24 hours. After this the coupons were removed, rinsed in demineralized water, dried in air and examined for weight loss and surface appearance and by scanning electron micrography and EDAX.

After exposure the coupons, which had previously had a dark oxide coating, were found to have a bright metallic appearance similar to that before the oxidation procedure. The absence of oxide was confirmed by EDAX analysis and the composition of the surface was equivalent to the base metal (i.e. no chromium enrichment). Weight loss calculation indicated that the coupons had lost approximately 5.44 mg $cm^{-2}$ Inconel and 0.90 mg $cm^{-2}$ Stainless Steel.

The ion exchange resin was visually examined, and no signs of damage had occurred, neither was there any reduction in flow rate or increase in pressure drop during the experiment, and there was no discernible loss in ion exchange capacity (conversion between hydrogen and sodium forms). It can be seen from the analytical results that the ion exchange column had operated exactly as predicted, lowering the pH and removing the metals.

TABLE 1

| Time Hours | BULK OF SOLUTION | | | | AFTER CATION IX | | | |
|---|---|---|---|---|---|---|---|---|
| | pH | Fe | Cr | Ni | pH | Fe | Cr | Ni |
| 3. | 2.8 | 0.91 | 0.79 | 5.07 | – | Ð | Ð | Ð |
| 4* | | | | | | | | |
| 5. | 2.24 | 0.42 | 0.36 | 1.56 | 2.23 | <0.05 | 0.1 | <0.05 |
| 9. | 2.22 | ND | ND | ND | 2.2 | ND | ND | ND |
| 14. | 2.18 | ND | ND | ND | 2.19 | ND | ND | ND |
| 18. | 2.17 | ND | ND | ND | 2.17 | ND | ND | ND |
| 22. | 2.15 | ND | 0.06 | ND | 2.15 | ND | 0.05 | ND |

* Commencement of Cation IX treatment
ND = Not Detected = below 50 ppb

EXAMPLE 2

Sample coupons were obtained from the primary circuit of an operational PWR. These samples were a specimen of Inconel 600 Steam Generator tube and a stainless steel coupon (Type 304L) from a man access cover. Analysis of radionuclides on the two coupons indicated 126 kBq $cm^{-2}$ Co-60 on the stainless steel and 103 kBq $cm^{-2}$ Co-58, 0.18 kBq $cm^{-2}$ Co-57 and 1.23 kBq $cm^{-2}$ Mn-54 on the Inconel tube. Non-radioactive surfaces of the coupons were blanked off with a silicone coating to prevent exposure to the decontamination solution.

The sample coupons were treated in the decontamination rig as in Example 1, except that the ion exchange resin used was a 1:1 mixed bed of IR-120 cation resin and IRA-400 anion resin previously regenerated with fluoroboric acid (i.e. the anion resin was in the fluoroborate form). The samples were measured for radioactivity by gamma spectrometry.

The process was operated for a period of 31 (Thirty One) hours using the same conditions as in Example 1. The sample holder and ion exchange column were monitored for decreasing and increasing radioactivity (respectively). After decontamination the samples were again measured using gamma spectrometry. The decontamination factors (Co-60 on the specimens before decontamination divided by Co-60 on the specimens after treatment) were 28 (Twenty Eight) for Inconel and 4 (Four) for Stainless steel. The process was discontinued at 31 (Thirty One) hours, but it was estimated that further running time of about 12 (Twelve) hours would complete the oxide and radioactivity removal.

The above-described embodiments and examples are illustrative of the present invention and should not be construed as limiting. Consequently, modifications may be made by those with skill in the art that are intended to be covered by the following claims.

What is claimed is:

1. A process for decontaminating a contaminated material comprising:

providing a solution containing less than 50 milli-moles of fluoroboric acid per liter;

contacting the fluoroboric acid solution with a material which causes the oxidation potential (Eh) of the solution to range from about 500 to about 1200 mV versus a Standard Calomel Electrode;

contacting the fluoroboric acid solution with the contaminated material; and, removing a contaminant from the contaminated material by continuously contacting the fluoroboric acid solutions with a cation exchange resin to remove the contaminants from the solution and to regenerate the fluoroboric acid in situ for use in continuous decontamination.

2. A process according to claim 1 wherein pH of the fluoroboric acid solution ranges from about 2 to about 3.

3. A process according to claim 1 wherein the material which causes the oxidation potential (Eh) of the solution to range is selected from the group consisting of hydrazine, hydrogen peroxide, ozone and combinations thereof.

4. A process according to claim 1 wherein the material which causes the oxidation potential (Eh) of the solution to range is ozone.

5. A process according to claim 1 further comprising maintaining temperature from about ambient to about 100° C.

6. A process according to claim 1 wherein the contaminant is selected from the group consisting of radioactive metal and derivative of radioactive metal.

7. A process for removing metal from a substrate comprising:

providing a solution containing less than 50 milli-moles of fluoroboric acid per liter;

contacting the fluoroboric acid solution with a material which causes the oxidation potential (Eh) of the solution to range from about 500 to about 1200 mV versus a Standard Calomel Electrode;

contacting the fluoroboric acid solution with the substrate; and, removing metal from the substrate by continuously contacting the fluoroboric acid solution with a cation exchange resin to remove the metal from the solution and to regenerate the fluoroboric acid in situ for use in continuous removal of metal.

8. A process according to claim 7 wherein pH of the solution ranges from about 2 to about 3.

9. A process according to claim 7 wherein the material which causes the oxidation potential (Eh) of the fluoroboric acid solution to range is selected from the group consisting of hydrazine, hydrogen peroxide, ozone and combinations thereof.

10. A process according to claim 7 wherein the material which causes the oxidation potential (Eh) of the fluoroboric acid solution to range is ozone.

11. A process according to claim 7 further comprising maintaining temperature from about ambient to about 100° C.

* * * * *